US005497590A

United States Patent [19]

Counihan

[11] Patent Number: 5,497,590

[45] Date of Patent: Mar. 12, 1996

[54] RESILIENT FLOORING

[76] Inventor: James Counihan, 50 Griffin Mill Rd., Piedmont, S.C. 29673

[21] Appl. No.: 398,993

[22] Filed: Mar. 6, 1995

[51] Int. Cl.[6] ..... E04F 13/08

[52] U.S. Cl. ..... 52/385; 52/391; 52/403.1; 52/480

[58] Field of Search ..... 52/480, 384, 387, 52/391, 506.05, 403.1, 396.1, 395, 393, 506.08, 509, 512

[56] References Cited

U.S. PATENT DOCUMENTS

| | | | |
|---|---|---|---|
| 1,693,655 | 12/1928 | Murphy . | |
| 2,862,255 | 12/1958 | Nelson | 20/6 |
| 3,271,916 | 9/1966 | Omholt | 52/393 |
| 3,518,800 | 7/1970 | Tank | 52/480 |
| 3,553,910 | 1/1971 | Omholt | 52/480 X |
| 3,828,503 | 8/1974 | Hofmann | 52/393 |
| 4,586,308 | 5/1986 | Jennings | 52/393 |
| 4,703,601 | 11/1987 | Abendroth | 52/509 |
| 4,819,932 | 4/1989 | Trotter, Jr. | 272/3 |
| 4,856,245 | 8/1989 | Osawa | 52/391 X |
| 4,856,250 | 8/1989 | Gronau et al. | 52/480 |
| 5,016,413 | 5/1991 | Counihan | 52/391 |
| 5,359,954 | 11/1994 | Kordelin | 52/391 X |

*Primary Examiner*—Lanna Mai
*Attorney, Agent, or Firm*—Henry S. Jaudon; Cort Flint

[57] ABSTRACT

A resilient flooring system arranged over a base floor which includes a layer of resilient pads supporting sub-floor panels in a generally side-by-side manner. Slots, in the form of an inverted L, are formed between opposed ends of the sub-floor panels and resilient pads. A limit bar, in the shape of a "Z" is arranged in the slots with its upper horizontal flanges extending in the upper horizontal leg of the slot and in engagement with a portion of one end of the sub-floor panels. Flooring boards are arranged over the slots and are secured with the sub-floor panels. Resilient strips are arranged in the slots over the lower horizontal leg of the limit bars. The resilient strips apply constant pressure to the under surface of the flooring boards in the area of the slots.

11 Claims, 2 Drawing Sheets

RESILIENT FLOORING

BACKGROUND OF THE INVENTION

The present invention relates to a resilient flooring system for gymnasiums and like areas.

Prior resilient flooring systems are known which provide resiliency for athletic activities such as aerobics, gymnastics and the like. U.S. Pat. No. 5,016,413, to the same inventor, is an example of a known system in which resiliency is achieved by providing a resilient covering over the base floor and supporting sub-floor sections in place over the resilient covering. The sub-floor sections are secured with the base floor by means of channel members which have oppositely extending upper flanges which engage over the edge surface of the sub-floor sections. The channel members are secured with the base floor by nails.

A problem arises in placing the edge portions under the horizontal ledges of the channel member and then securing the channel members in position. In one embodiment, an upper horizontal ledge over lays and partially obscures a lower securing horizontal ledge. In a second embodiment, the anchoring nail must be inserted in a narrow channel between spaced vertical strips. Also, controlling opposed ends of the sub-floor sections creates an inflexible structure. Another undesirable feature of this construction is the width to which the channel must be cut to accommodate oppositely directed flanges. The channel space may create dead spots along the floor.

Accordingly, it is an object of the present invention to provide a flooring system resilient flooring system which may be easily and quickly installed.

Another object of the present invention is to provide a resilient flooring system which comprises a unitary flooring.

Another object of the present invention is to provide a resilient flooring which removes high and low spots present in the base floor.

Another object of the invention is a resilient flooring with no dead spots.

SUMMARY OF THE INVENTION

The instant invention is directed to a simplified resilient flooring assembly which is easily and quickly assembled. The flooring system comprises a layer of resilient foam material which covers the base floor. A plurality of elongated sub-floor panels are arranged over the resilient material in a generally side-by-side manner.

A "Z" shaped limit bar is arranged in slots between edges of sub-floor sections to limit vertical movement upward of one end of the sub-floor panels. The base floor limits downward vertical movement of the sub-floor panels while the resilient materials allows limited vertical movement.

The limit bar includes a vertical stem which mounts an upper horizontal flange which extends in a first direction from an upper edge and a lower horizontal flange which extends from the lower edge of the stem in the opposite direction.

One of the slot forming edges of the sub-floor panels includes an upwardly extending first side terminating at an inwardly extending abutment ledge. The ledge terminates with a second upwardly extending side which terminates at the upper surface of the floor section. The opposite edge of the sub-floor panel extends vertically along a single plane.

A resilient strip is positioned in the slot and located between vertical end of the sub-floor panel and the vertical stem of the limit bar. The resilient strip is sized to be slightly larger than the slot. Flooring boards are arranged over the slot and secured with the sub-flooring sections forming an integral resilient flooring. The resilient strip engages the lower surface of the flooring boards forming a continuous support surface floor board support surface.

In practice, the resilient material is laid over the base floor so as to substantially cover its entire surface area. A first row of sub-floor panels are located and a first limit bar is positioned adjacent first ends thereof with its upper lateral edge extending over the abutment ledge formed the edge thereof. The oppositely extending lower horizontal ledge is penetrated by anchoring members and secured with the base floor. Because the horizontal flanges extend in opposite directions, the strips are easily attached with the base floor because the lower flange is unobstructed. Also, the end of the sub-floor panel is evenly held by the upper horizontal flange.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
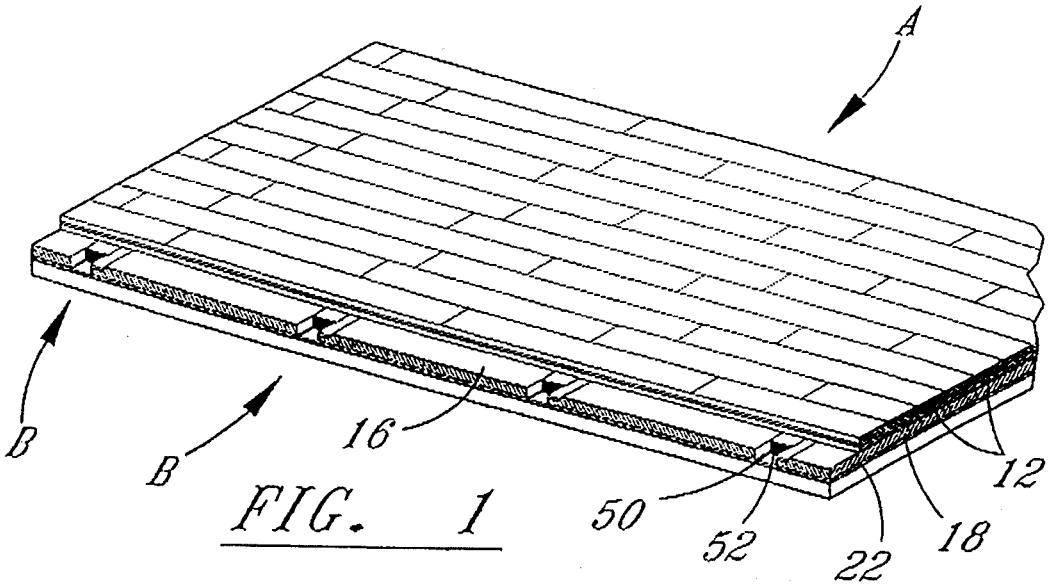
FIG. 1 is a sectional plane view of the resilient flooring system of the invention.

Referring now to the drawings, the invention will now be described in more detail.

Turning to the drawings, FIG. 1, flooring system A of the invention is shown to include base floor 10 formed by flooring boards 12. Flooring boards 12 are secured with sub-flooring panels 16 by usual means such as brads 14 or nails (not shown). Sub-flooring panels 16 are supported by foam pads 18 which are separated from base floor 20 by plastic sheets 22.

Figure 2:
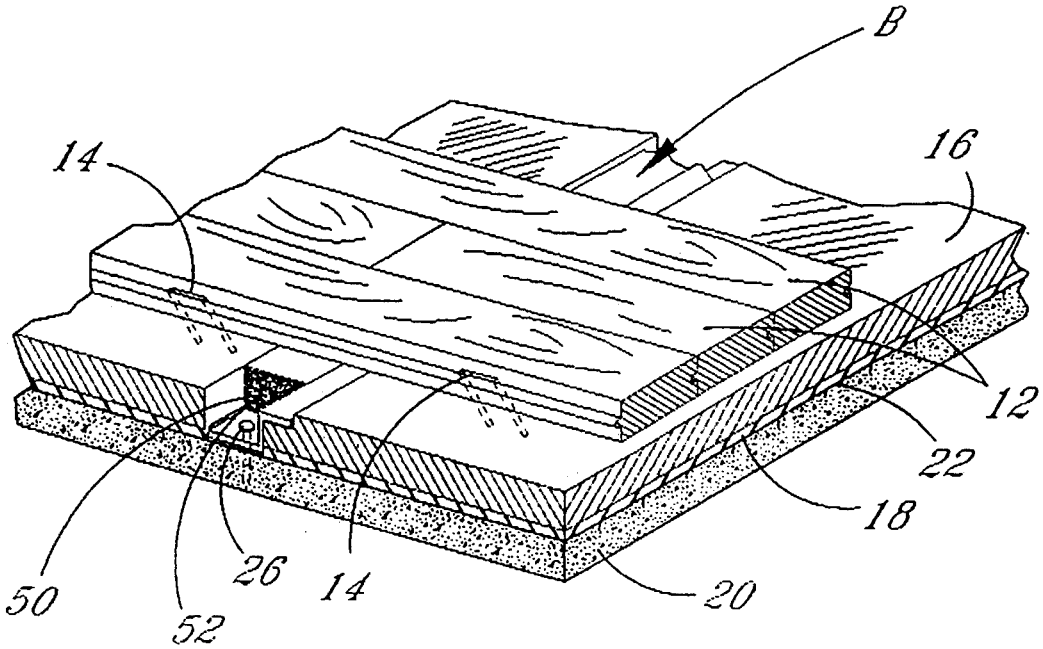
FIG. 2 is a sectional perspective view of the floor securing structure for the resilient flooring system of the invention.
Figure 3:
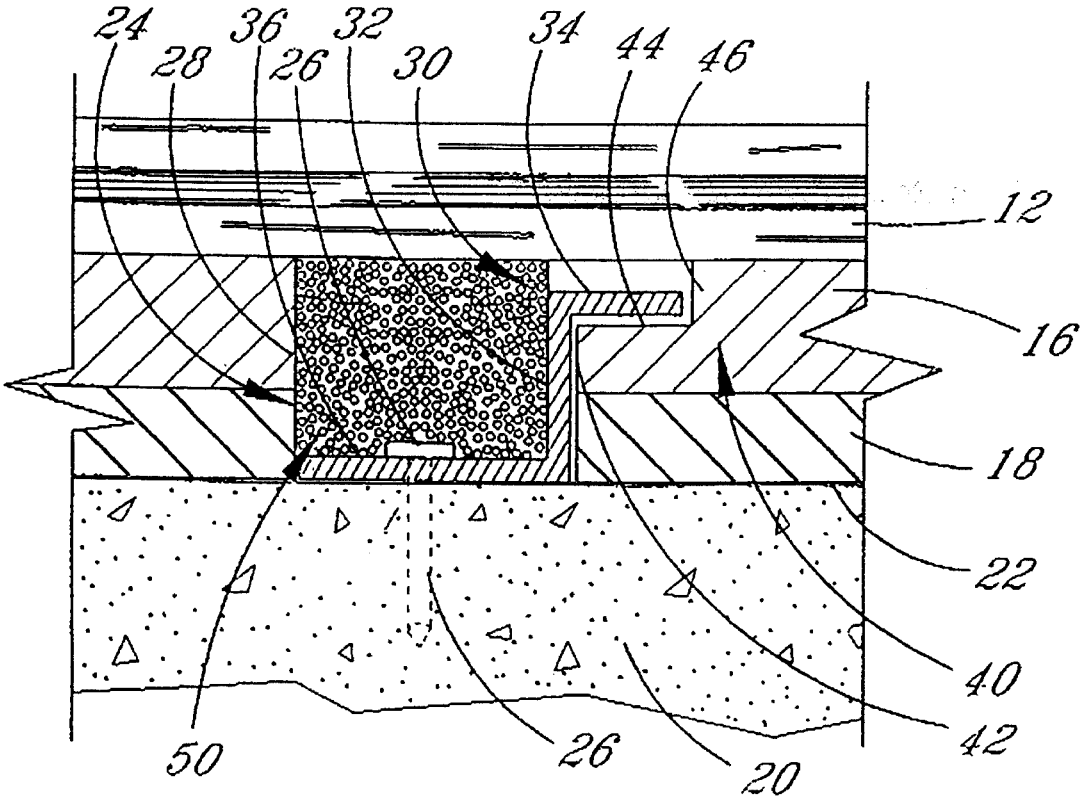
FIG. 3 is a sectional enlarged side view of the flooring system of FIG. 2.

Referring now to FIGS. 2 and 3, it can be seen that flooring system A is formed by covering base floor 20, which is usually concrete, with a plastic sheet 22, preferably polyethylene, which acts as a shield to keep moisture away from the remainder of flooring system A, and particularly away from foam pads 18. Upon covering base floor 20 with sheets 22 a plurality of rows of limit bars B are located lengthwise the base floor 20 and are arranged transversely thereof in rows spaced at slightly more than 2', and are secured with base floor 20 by usual fasteners such as concrete nails 26.

Limit bars B comprise fastening strips 30 which are generally "Z" shaped. Strips 30 include a vertical stem 32 to which has attached along its upper edge a horizontal upper flange 34 and along its lower edge an oppositely directed horizontal lower flange 36. Flange 36 is adapted to be secured with sheet 22 and base floor 20 by a plurality concrete nails 26. Other suitable fasteners may be used to secure flange 36 with the base floor.

A plurality of foam pads 18 are laid side-by-side across the width of base floor 20 between the rows of limit bars B in side-by-side fashion. A first end of pads 18 is positioned beneath flange 34 and adjacent stem 32 while the second end of pads 18 is arranged adjacent the edge of lower flange 36 as clearly shown in FIG. 3. Preferably pads 18 are formed of ¼" rubber or foam shaped into various widths and into lengths of 2'.

Sub-floor panels 16 are arranged side-by-side over foam pads 18. First ends 40 of panels 16 are formed to have a first edge 42 which extends from the panel base vertically to terminate with inwardly directed edge 44. Ledge 44 extends horizontally to terminate with second edge 46 which extends upwardly to terminate with the upper surface of sub-floor panel 16.

First end 40 is positioned beneath horizontal flange 34 and against stem 32. Flange 34 extends in the space over shoulder 44 which space is created between the shoulder and the upper surface by edge 46.

A second end 28 of sub-floor panels 16 is arranged adjacent the outer end of lower flange 36 and in alignment with the second end of foam pads 18. These second ends form a vertical wall 24.

Sub-floor panels 16 are preferably formed of plywood panels which are 2' in length, 4' in width, and between ½" and 1" thick. Panels 16 may be laid end-to-end or side-by-side.

Vertical wall 24 and first ends 40 form a channel, shaped as an inverted L, in which limit bars B are located. Edge 46, along with ledge 44, define the space in which flange 34 is located, normally is arranged to extend vertically and perpendicularly of the upper and lower surfaces of sub-floor angle to increase the size of the channel to reduce the chances of the sub-floor panels binding with the limit bars B.

Wall 24 and vertical stem 32 create a second channel 50 over which the floor boards extend when positioned over the sub-floor panels 16. It has been found that by filling these channels 50 with foam strips as illustrated at 52 hollow sounds may be eliminated and by providing more even support, dead spots may be removed. Strips 52 are sized to be slightly larger in both width and height than channel 50 so that when flooring boards 12 are secured in place pressure is applied to the underside of the boards. Preferably strips 52 are 1½"×½".

With foam pads 18 and sub-floor panels 16 in place, it is apparent that only first ends 40 are secured against vertical movement by limit bars B while second ends 24 are unrestrained. It is in this condition that flooring boards 12 are laid over sub-floor panels 16 to extend transverse of slots 50. Boards 12 are secured along their length with sub-floor sections 16 by brads 14. With boards 12 secured with panels 16 an integral floor is formed. This integral floor is capable of only limited vertical movement downward by compression of resilient pads 18. Vertical upward movement is also limited by flange 34 engaging with shoulder 44. Resilient pads 18 absorb slight variations in base floor 20, such as waves, so that flooring 12 is substantially flat. Resilient strips 52 press continuously against lower surface of flooring boards 12 where they pass over slots 50 and absorb noise, remove hollow sounds and dead spots when this section of the floor is engaged.

Resiliency is obtained and controlled by the combination of resilient panels 18 which allow downward vertical movement of integral flooring 12, 16 and limit bars B which limit the vertical upward movement of the integral flooring.

While a preferred embodiment of the invention has been described using specific terms, such description is for illustrative purposes only, and it is to be understood that changes and variations may be made without departing from the spirit or scope of the following claims.

What is claimed is:

1. A resilient flooring system for assembly on a base surface to provide a resilient floor comprising:

a layer of a resilient material carried on and substantially covering said base surface;

a plurality of elongated sub-floor panels arranged over said resilient material and generally co-extending with said floor in a side-by-side arrangement;

a slot defined between adjacent sub-floor panels having an open top;

a limit bar carried in said slot limiting vertical movement of selected ends of said sub-floor panels in an upward direction while leaving unrestrained other ends of said sub-floor panels, said limit bar permitting vertical movement in an opposite downward direction of said selected sub-floor panels;

a plurality of flooring boards extending transverse to said sub-floor panels bridging said open top of said slot, said flooring boards having an upper floor surface defining an exterior floor and a lower floor surface; and fasteners attaching said flooring boards to said sub-floor panels joining the remainder of said sub-floor panels with said selected ends of said sub-floor panels; whereby, said exterior floor and sub-floor panels form an integral flooring capable of vertical movement as limited by said limit bar and base surface.

2. The system of claim 1 wherein each of said sub-floor panels have an upper surface, a first edge and a second edge opposite said first edge, said first edge includes an upwardly extending first side terminating at an inwardly extending abutment ledge, said abutment ledge terminating at an upwardly extending second side which terminates at said upper surface, said second edge extending upwardly along a single plane and terminating at said upper surface.

3. The system of claim 2 wherein said first and second edges originate at a base surface of said sub-floor panel.

4. The system of claim 3 wherein said limit bar includes a first horizontal flange engaged by said abutment ledge to limit the upper movement of said first edge and a second lower horizontal flange engaged with said base floor anchoring said bar with said base floor.

5. The system of claim 4 wherein said slot comprises a widened groove defined between said abutment ledge and said flooring boards in which said horizontal flange is disposed for relative movement.

6. The system of claim 1 including a resilient strip positioned within said slot, said strip continuously engaging with said lower floor surface and said limit bar to apply even pressure against said lower floor surface.

7. A resilient flooring system for assembly on a base surface to provide a resilient floor comprising:

a plurality of sub-floor panels carried above said base surface to define a sub-floor, said sub-floor panels each have an upper surface, a first edge and a second edge opposite said first edge, and said first edge includes an upwardly extending first side terminating at an inwardly extending abutment ledge, said abutment ledge terminating at an upwardly extending second side, said second side terminating at said upper surface, and said second edge extending upwardly along a single plane and terminating at said upper surface;

an inverted L shaped slot formed between adjacent sub-floor panels by said first and second edges;

a plurality of flooring boards extending transverse to said sub-floor panels bridging said slots to define a floor, and attachment members attaching said flooring boards to said sub-floor panels so that said flooring boards and sub-floor panels are united forming integral flooring;

stationary limit bars disposed within said slots and affixed to said base surface engaging said sub-floor panels in said slot along said first edge in such a manner to allow downward movement of said integral flooring while limiting upward movement of said integral flooring relative to said base surface said limit bars including a first flange engaging said first edge of a first sub-floor section on a first side of said limit bars, and said limit bar including second flanges engaging with said base floor on a second side thereof; and a layer of resilient material carried between said base surface and said sub-floor panels biasing said sub-floor panels upwards against said first flange so that said integral flooring moves vertically relative to said stationary limit bars to provide a resilient floor.

8. The system of claim 7 wherein said slot includes a resilient strip between said limit bars and said second edges of sub-adjacent flooring panels, said strips being in continuous engagement with said flooring boards.

9. The system of claim 7 wherein said first flange is disposed over and abuts said abutment ledge.

10. The system of claim 7 wherein said sub-floor panels extent over generally the entire area of said base surface.

11. The system according to claim 7 wherein said limit bars comprise a generally "Z" shaped channel member having a vertical stem, said first flange extends laterally in a first direction from an upper edge of said vertical stem and said second flange extends laterally in an opposite direction from a lower edge of said vertical stem, fasteners, passing through said second lateral flange securing said limit bars with said base floor.

* * * * *